US011209250B2

(12) United States Patent
Zuriaga Gascón et al.

(10) Patent No.: US 11,209,250 B2
(45) Date of Patent: Dec. 28, 2021

(54) DETONATOR RETENTION SYSTEM FOR BOOSTERS

(71) Applicant: MaxamCorp Holding, S.L., Madrid (ES)

(72) Inventors: José Zuriaga Gascón, Madrid (ES); José Luis de Miguel Fuentes, Madrid (ES)

(73) Assignee: MAXAMCORP HOLDING, S.L., Madrid (ES)

( * ) Notice: Subject to any disclaimer, the term of this patent is extended or adjusted under 35 U.S.C. 154(b) by 0 days.

(21) Appl. No.: 16/606,642

(22) PCT Filed: Apr. 17, 2018

(86) PCT No.: PCT/EP2018/059719
§ 371 (c)(1),
(2) Date: Oct. 18, 2019

(87) PCT Pub. No.: WO2018/192900
PCT Pub. Date: Oct. 25, 2018

(65) Prior Publication Data

US 2020/0041238 A1 Feb. 6, 2020

(30) Foreign Application Priority Data

Apr. 18, 2017 (EP) ..... 17382206

(51) Int. Cl.
*F42B 3/26* (2006.01)

(52) U.S. Cl.
CPC ..... *F42B 3/26* (2013.01)

(58) Field of Classification Search
CPC ..... F42B 3/26; F42B 3/28; F42D 1/043
USPC ..... 102/331, 304, 322, 318, 332, 275.12
See application file for complete search history.

(56) References Cited

U.S. PATENT DOCUMENTS

| | | | | |
|---|---|---|---|---|
| 2,993,441 A | | 7/1961 | Griffith et al. | |
| 3,407,730 A | | 10/1968 | Griffith | |
| 4,637,312 A | * | 1/1987 | Adams | F42B 3/26 102/275.12 |
| 4,799,428 A | * | 1/1989 | Yunan | C06C 7/00 102/275.12 |

(Continued)

FOREIGN PATENT DOCUMENTS

| | | | |
|---|---|---|---|
| EP | 2177866 | A1 | 4/2010 |
| WO | WO-2018192900 | A1 | 10/2018 |
| ZA | 200203212 | B | 12/2002 |

OTHER PUBLICATIONS

"European Application No. 17382206.5, PCT Direct Informal Comments dated Apr. 17, 2018", (Apr. 17, 2018), 12 pgs.

(Continued)

*Primary Examiner* — Jonathan C Weber
(74) *Attorney, Agent, or Firm* — Tristan A. Fuierer; Olive Law Group, PLLC

(57) ABSTRACT

The present invention relates to a device, a system and a method for retaining detonators in an explosive booster, particularly a retention device for retaining a detonator in the blind hole of a booster which allows the safe extraction thereof from the booster. The retention device comprises a flexible holding means that is movable between a blocking position retaining the detonator inside the blind hole and an open position which allows extracting the detonator from the blind hole.

17 Claims, 9 Drawing Sheets

(56) References Cited

U.S. PATENT DOCUMENTS

| | | | | |
|---|---|---|---|---|
| 4,815,382 | A * | 3/1989 | Yunan | C06C 5/06 102/275.12 |
| 6,112,666 | A | 9/2000 | Murray et al. | |
| 9,115,963 | B2 * | 8/2015 | Most | F42D 1/04 |
| 2014/0345486 | A1 * | 11/2014 | Most | F42B 3/28 102/322 |

OTHER PUBLICATIONS

"International Application No. PCT/EP2018/059719, International Preliminary Report on Patentability dated Jul. 8, 2019", (Jul. 8, 2019), 12 pgs.

"International Application No. PCT/EP2018/059719, International Search Report and Written Opinion dated Jun. 18, 2018", (Jun. 18, 2018), 12 pgs.

* cited by examiner

DETONATOR RETENTION SYSTEM FOR BOOSTERS

PRIORITY CLAIM TO RELATED APPLICATIONS

This application is a U.S. national stage filing under 35 U.S.C. § 371 from International Application No. PCT/EP2018/059719, filed on 17 Apr. 2018, and published as WO2018/192900 on Oct. 25, 2018, which claims the benefit under 35 U.S.C. 119 to European Patent Application No. 17382206.5, filed on Apr. 18, 2017, the benefit of priority of each of which is claimed herein, and which applications and publication are hereby incorporated herein by reference in their entirety.

OBJECT OF THE INVENTION

The present invention relates to a device, a system and a method for retaining detonators in an explosive booster, particularly a retention device for retaining a detonator in the blind hole of a booster which allows the safe extraction thereof from the booster.

BACKGROUND OF THE INVENTION

Explosive boosters are explosive charges that are used for setting off low-sensitivity detonating explosives, such as emulsions, hydrogels and mixtures of ammonium nitrate and fuel.

The boosters are usually set off with a conventional detonator and have at least one through hole and a blind hole for housing the detonator. The detonator, which is usually in a cylindrical shape and can have different types of electrical wires or a plastic tube for its activation, is passed through the through hole and then completely introduced into the blind hole.

The booster assembly, comprising the booster, the detonator and its wires, is then introduced into a shot hole. In this operation, the wires of the detonator are subjected to stresses that may cause the detonator to come completely or partially out of the blind hole, leading to a malfunctioning of the blasting operation. In the case of detonation failure, the action of removing the booster with the detonator introduced therein involves serious risks.

There are various explosive booster designs without detonator retention systems that work in less demanding working conditions, but they are not able to withstand jolting, blows, or rough handling of the booster assembly. Several solutions for retaining the detonator have been proposed today, although some of them are susceptible to failure.

For example, systems using an O-ring made of an elastic material, for example rubber, placed in the blind hole of the booster, capable of retaining the detonator inside the booster, are known. This retention system inside the explosive charge generates risks in detonator handling, particularly if the extraction thereof is required.

U.S. Pat. No. 6,112,666 A describes a part for a booster with a side notch in which a shock tube-type plastic tube can be introduced and retained by pressure for detonator activation. The main drawback is that this system is only valid for non-electrical activation tubes.

US patent application 2014/0345486 A1 describes a circular casing with a hollow plastic cylinder for housing the detonator. The hollow cylinder has an edge at the open end thereof which allows retaining the detonator by pressure. This system does not allow easy and safe extraction of the detonator either, and if the operator decides to remove said detonator, he must pull on the detonator forcefully, which is not only dangerous but may also cause damage to the booster.

Other retention systems allow on the one hand removing the detonator once introduced into the blind hole but on the other hand, these systems comprise a large number of parts and are extremely complex, furthermore having a high economic cost.

DESCRIPTION OF THE INVENTION

The present invention proposes a solution to the preceding problems by means of a retention device according to claim 1, a booster according to claim 9 and methods of assembling and disassembling according to claims 14 and 15, respectively. The dependent claims define preferred embodiments of the invention.

A first inventive aspect provides a retention device adapted to retain detonators inside a booster, said booster comprising:

- an explosive charge,
- a through hole comprising a first end and a second end, and
- a blind hole comprising one end, wherein the retention device comprises,
- at least one substantially flat portion,
- at least one outer face and at least one inner face,
- at least one flexible holding means located substantially in said at least one substantially flat portion, and can be accessed or handled by an operator from the at least one outer face,
- at least one first opening located in said at least one substantially flat portion and
- at least one second opening located in said at least one substantially flat portion, wherein
- the at least one first opening is adapted to allow the detonator to access the through hole, and
- the at least one second opening is adapted to allow the detonator to access the blind hole, characterized in that the at least one flexible holding means is arranged substantially next to each at least one second opening, and said flexible holding means are adapted to be movable between a blocking position retaining a detonator inside the blind hole and an open position which allows extracting the detonator from said blind hole.

Throughout this document, a substantially flat portion will be understood as a structural element making up the device which, without necessarily being flat, defines a base on which other elements of the retention device are arranged.

A flexible material must be interpreted as a material capable of deforming elastically, i.e., a material which can recover its original shape after going through deformation. Advantageously, the material of the flexible holding means is a polymeric or metallic material with said property, such as polypropylene, for example. It will furthermore be understood that the term "holding means" is equivalent to "flexible holding means".

A hole must be interpreted as a perforation or bore which, as indicated, can be through or blind, i.e., going through the solid completely or not going through the solid completely, respectively. Preferably, these holes are parallel to the longitudinal axis of the booster, in the case in which this is cylindrical or prismatic.

Inner face and outer face must be interpreted herein as the inner and outer surfaces of the retention device, respectively, that are defined by the substantially flat portion. In a particular embodiment, the inner face is configured for housing the booster.

Arranged next to will be understood as meaning that the element is arranged at a small distance in relation to the size of the elements involved. In a particular embodiment, the elements are the holding means and the second opening, such that the holding means can block the access to the blind hole in the standby position, and can move at the same time to allow the passage of a detonator in the open position.

Advantageously, an operator can easily handle the flexible holding means without having to use a tool or a specific implement for moving the holding means from the outside of the booster, for example, with one finger. As an additional advantage, the movement of the holding means brings said holding means to the open position, releasing the detonator without exerting pressure directly on same and allowing the safe extraction thereof.

In a particular embodiment, the retention device additionally comprises a protective element, said protective element comprising a substantially flat surface with a recess, said recess being adapted for housing the at least one substantially flat portion, the at least one flexible holding means, the at least one first opening and the at least one second opening, allowing the operation of the at least one flexible holding means.

Advantageously, the protective element confers the retention device with an additional degree of protection, interposing a solid element between the external environment and the holding means, which are thereby sheltered from impacts and blows.

In a particular embodiment, the retention device comprises one or more centering ribs arranged in the at least one substantially flat portion and substantially next to each at least one second opening, the one or more centering ribs being adapted to guide a detonator through each at least one second opening when said detonator is introduced in said at least one second opening.

In another particular embodiment, the centering ribs can be substantially thin.

Advantageously, the centering ribs help to orientate and guide the detonator towards the blind hole with ease before it has been introduced therein.

In a particular embodiment, the retention device comprises two second openings.

Advantageously, including two openings in the retention device allows introducing two detonators in the booster, in those cases in which a second detonator is required for setting off the booster.

In a particular embodiment, the flexible holding means is a flange connected to the at least one substantially flat portion, wherein the flange comprises an edge adapted to retain a detonator in the blind hole.

Advantageously, the flange performs the double function of the invention of retaining the detonator in its position and of being able to move with ease between two positions, an open position and a blocking position.

In a particular embodiment, the end of the flange connected to the at least one substantially flat portion and the substantially flat surface of the protective element are connected through a wall.

In a particular embodiment, the flange comprises a free end defined as a conical or flat and inclined surface of revolution.

Advantageously, the particular shape of the flange helps moving it without having to manually push it from one position to another when it is pushed by the detonator at the moment of introducing said detonator, which makes the operation thereof with just one hand easier.

In a particular embodiment, the device comprises two flexible holding means which can advantageously be two flanges such as those described. The incorporation of a second flange allows the retention device to keep the detonator in the hole even if one of the flanges is rendered useless during handling.

In a particular embodiment, the retention device is prismatic or cylindrical.

Advantageously, a cylindrical retention device can be used with a cylindrical-shaped conventional booster, such as most commercially available boosters.

In a second inventive aspect, the invention provides a booster comprising an explosive charge and a retention device, in which the retention device is located at one of the ends of the booster.

Advantageously, the retention device can be used in a conventional booster or in a booster manufactured specifically by means of a casting process.

In a particular embodiment, the booster has a cylindrical or prismatic shape.

Advantageously, the cylindrical shape allows using the booster in shot holes having that same configuration, which is the most common one in practice.

In a particular embodiment, the booster comprises a case, in which the case of the booster is adapted to contain the explosive charge and the retention device is located at a first end of the case.

The case, with a retention device at one of its ends, advantageously contains and envelops the booster and can be handled as a whole.

In a particular embodiment, the booster comprises a cover located at a second end of the case.

Advantageously, the cover allows completely covering the explosive charge, both in order to protect it from impacts or/and contaminants and to be able to store and handle it with ease and it further comprises an opening providing access to the through hole.

In another particular embodiment, the booster comprises at least one through hole in the explosive charge and at least one blind hole in the explosive charge, such that the longitudinal axis of each through hole coincides with the longitudinal axis of each first opening of the retention device and the longitudinal axis of each blind hole coincides with the longitudinal axis of each second opening of the retention device.

The openings, arranged coaxially with respect to the holes, advantageously allow introducing a detonator attached to its setting wires into the holes.

In a third inventive aspect, the invention provides a method of assembling a booster, comprising the following steps:

providing a booster, introducing a detonator through a first end of the through hole of the booster, until the detonator comes out through the second end of the through hole of the booster, and introducing the detonator through the end of the blind hole of the booster by applying force on the flexible holding means moving the flexible holding means from the blocking position to the open position, such that when the detonator is completely housed in the blind hole, the flexible holding means return to the blocking position.

In a last inventive aspect, the invention provides a method of disassembling a booster, comprising the following steps:

providing an assembled booster, unblocking the holding means by applying force on the flexible holding means moving the flexible holding means from the blocking position to the open position, and pulling on the end of the detonator and extracting the detonator from the booster.

All the features and/or the steps of the methods described in this document (including the claims, description and drawings) can be combined in any combination, with the exception of the combinations of such mutually exclusive features.

DESCRIPTION OF THE DRAWINGS

The foregoing and other features and advantages of the invention will be more clearly understood based on the following detailed description of preferred embodiment, provided only by way of illustrative and non-limiting example in reference to the attached drawings.

DETAILED DESCRIPTION OF THE INVENTION

Figure 1:
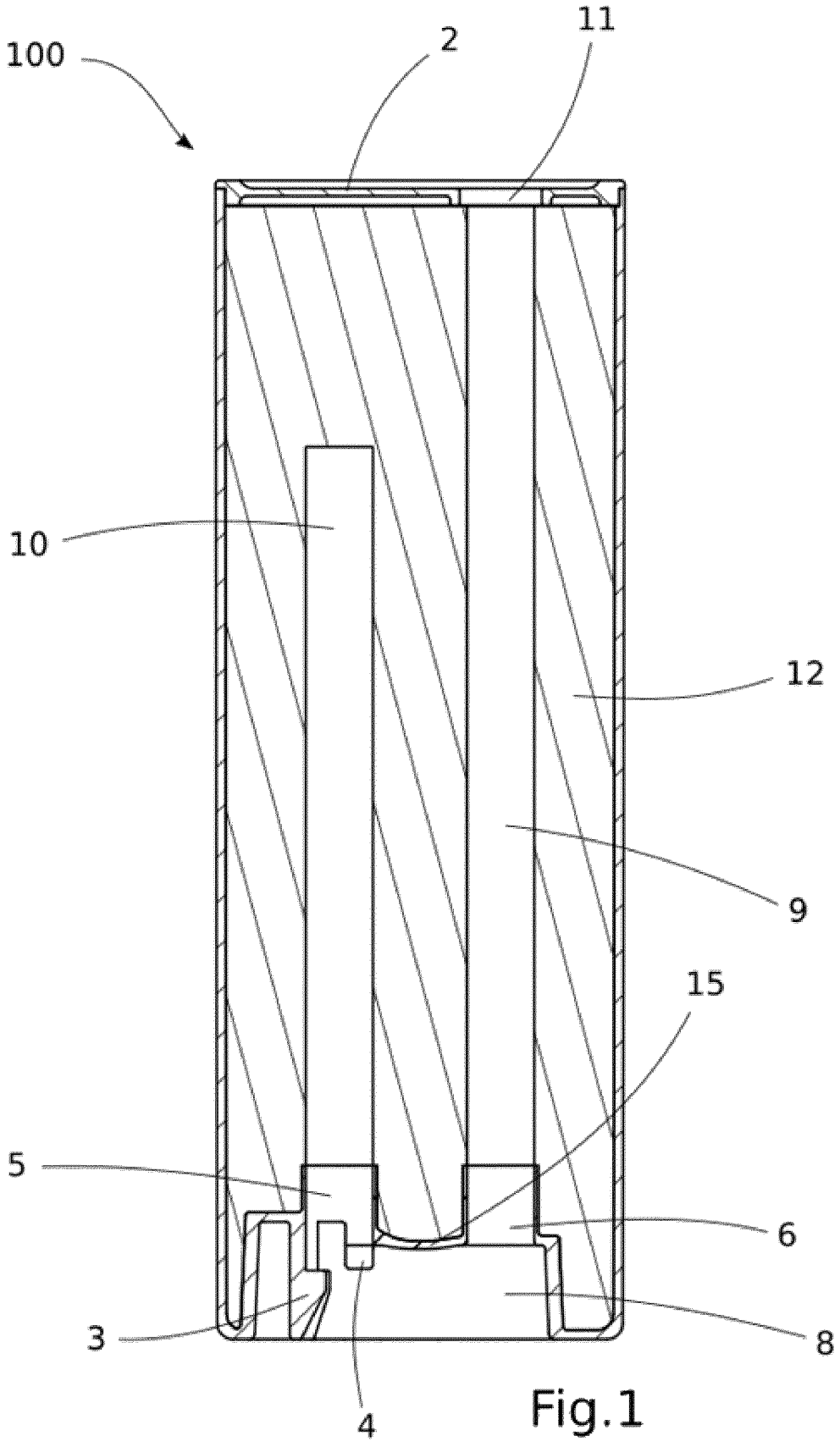
FIG. 1 shows a longitudinal section of the booster.

The present invention relates to a retention device (1) for detonators (13) in an explosive booster (100), an explosive booster (100) and a method of assembling and disassembling same. Particularly, it relates to a device which allows effectively retaining one or more detonators (13) inside a hole (10) of the booster which does not only prevent the detonator from coming completely or partially out of the hole (10) where it is housed, but also allows extracting the detonator safely if blasting is suspended, such that the risk of accident during handling is minimized. An additional advantage is that, effectively, the retention device (1) is arranged outside the booster (100), reducing the risk of damaging the explosive charge (12) during handling and allowing the operation of the retention device (1) by simply moving the flexible holding means or device (3) with one finger.

LIST OF NUMERICAL REFERENCES

1 Retention device
2 Cover
3 Flexible holding means
3*a* Free end
3*b* Flat intermediate part
3*c* Cylindrical inner part
4 Centering rib
5 Second opening
6 First opening
8 Wall
9 Through hole
10 Blind hole
11 Perforation
12 Explosive charge
13 Detonator
15 Substantially flat portion
16 Inner face
17 Outer face
18 Substantially flat surface
19 Recess
20 Protective element
100 Booster Booster The booster (100) is an element known in the field of the art consisting of a very powerful explosive charge (12), envisaged for setting off other low-sensitivity explosives. Generally, boosters are formed by a cylindrical block of explosive material or explosive charge (12) with two perforations or holes, a through perforation (9) and another blind perforation (10), and externally covered by a casing commonly referred to as a case or shell, made of a lightweight material, such as plastic, for example. The blind hole (10) is used for housing the detonator (13) intended for setting off the booster (100), whereas the through perforation (9) is intended for allowing the passage of the detonator attached to its setting wire through the booster; once on the opposite side, the detonator (13) is completely introduced into the blind perforation (10), only the portion corresponding to the connection with the wires projecting outwards.

Preferably, the retention device (1) is placed at the lower end of the booster (100) such that it retains the detonator more securely as a result of the wire being lopped once through the through hole (10) of the booster, preventing the entire weight of the booster assembly from being supported by the retention device (1). Therefore, when the booster assembly is introduced to the bottom of a shot hole, the booster does not hang directly from the retention device, rather part of the stress is absorbed by the wires that have been passed through the through hole (10) of the booster (100).

Figure 3:
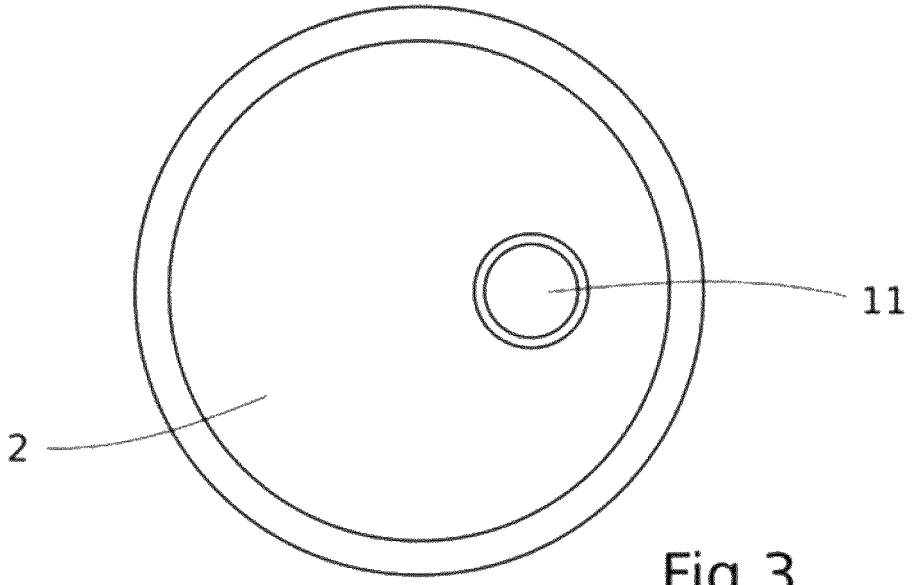
FIG. 3 shows a top view of the booster.

It is possible to manufacture the booster by means of a process of casting the explosive material directly in the case, placing metal rods for obtaining the through hole (9) and the blind hole (10). It is also possible to integrate the retention device (1) with the case of the booster. The booster can therefore be manufactured with a minimum of processes and of individual parts. Finally, a cover (2) with a perforation (11) which allows accessing the through hole (9), and which at the same time closes the case and protects the explosive charge (12) of the booster, as shown in FIG. 3, can be placed.

This solution prevents the use of plastic tubes for the hole of the detonator, thereby not only reducing the number of parts and material used, but allowing better wave transmission from the detonator to the explosive charge of the booster.

Retention Device

Figure 2:
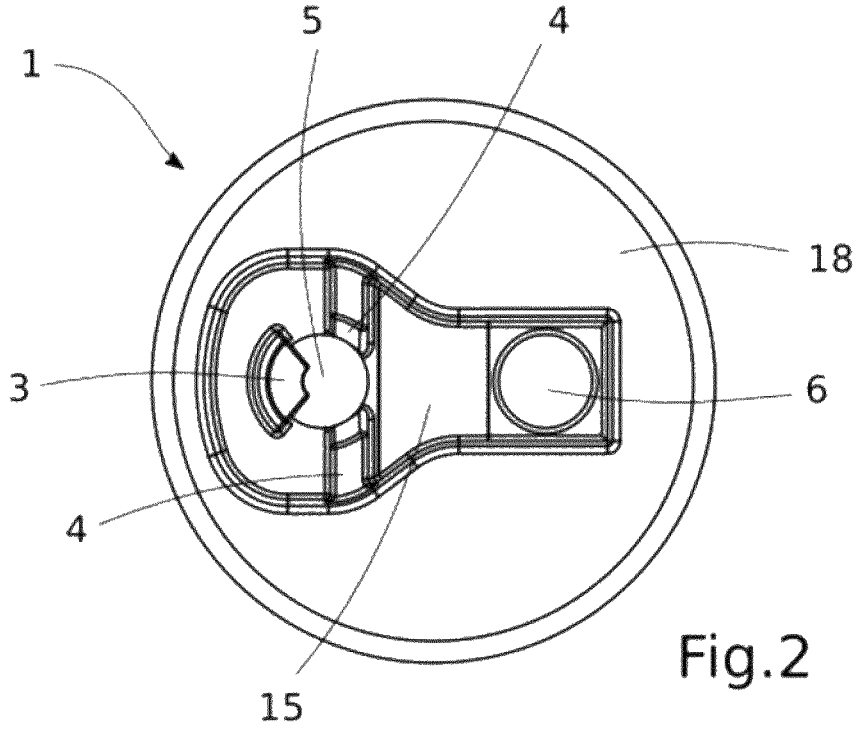
FIG. 2 shows a bottom view of the booster, in which the retention device can be seen.

FIG. 2 shows the lower end of a booster (100) in which the retention device (1) and the position of the flexible holding means (3) and the centering ribs (4) can be seen. In a preferred embodiment, such as the one shown in FIG. 1, the retention device (1) comprises two openings (5, 6), centering ribs (4) and flexible holding means (3) which in the present embodiment correspond to a flexible flange.

Figure 5:
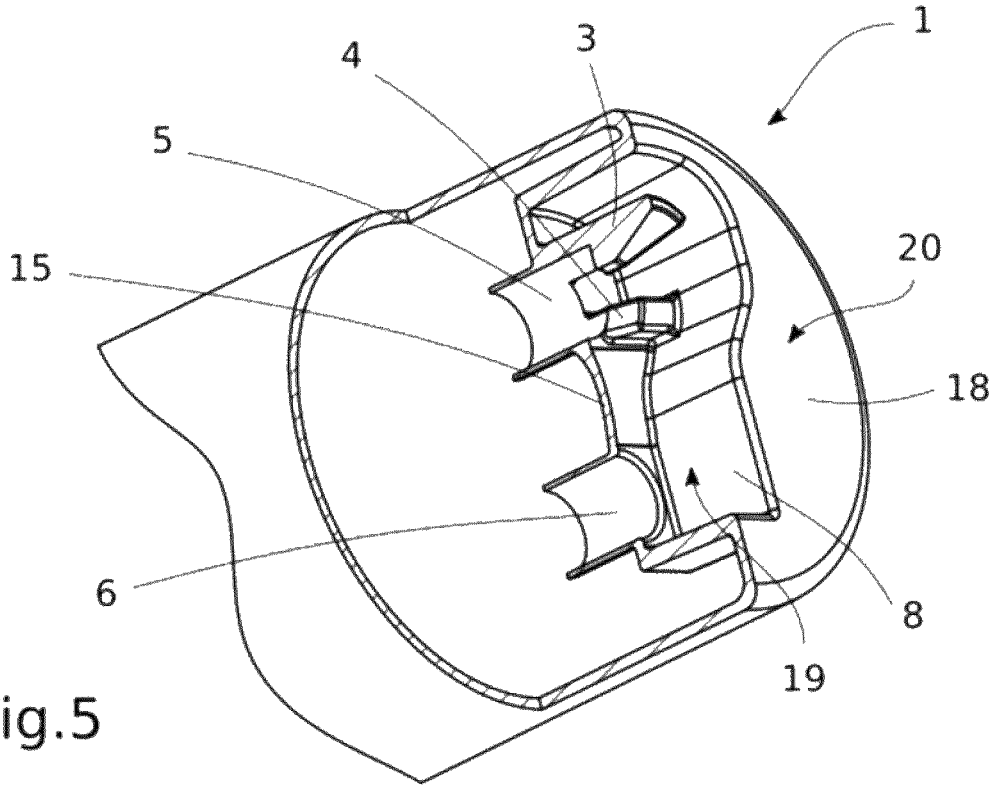
FIG. 5 shows a perspective cut-away view of the retention device.
Figure 6:
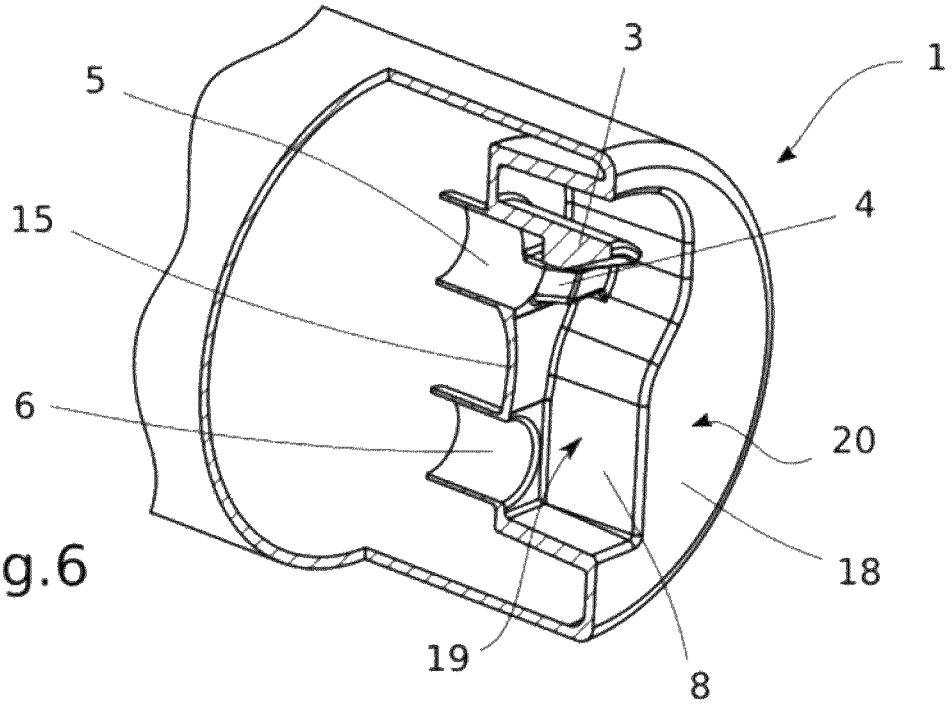
FIG. 6 shows another perspective cut-away view of the retention device from a different angle

FIG. 5 shows the element identified as the substantially flat portion (15), corresponding to a base on which the flexible holding means (3), the centering ribs (4) and the openings (5, 6) are located. Generally, this flat portion (15) is the structural element supporting the retention device (1), and can form a step, as seen in FIGS. 5 and 6, or be arranged at a different level.

Figure 4:
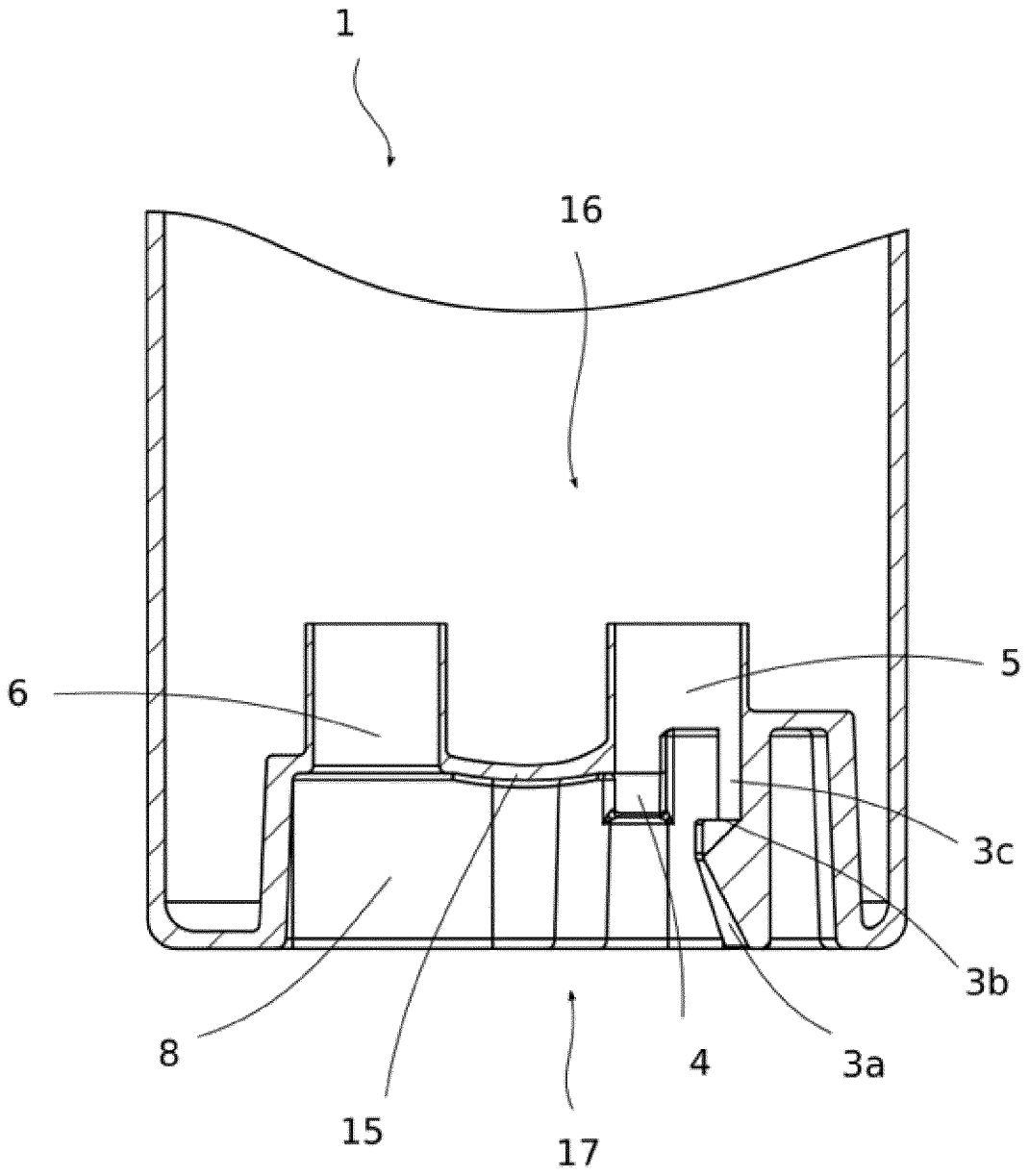
FIG. 4 shows a longitudinal section of the retention device.
Figure 7:
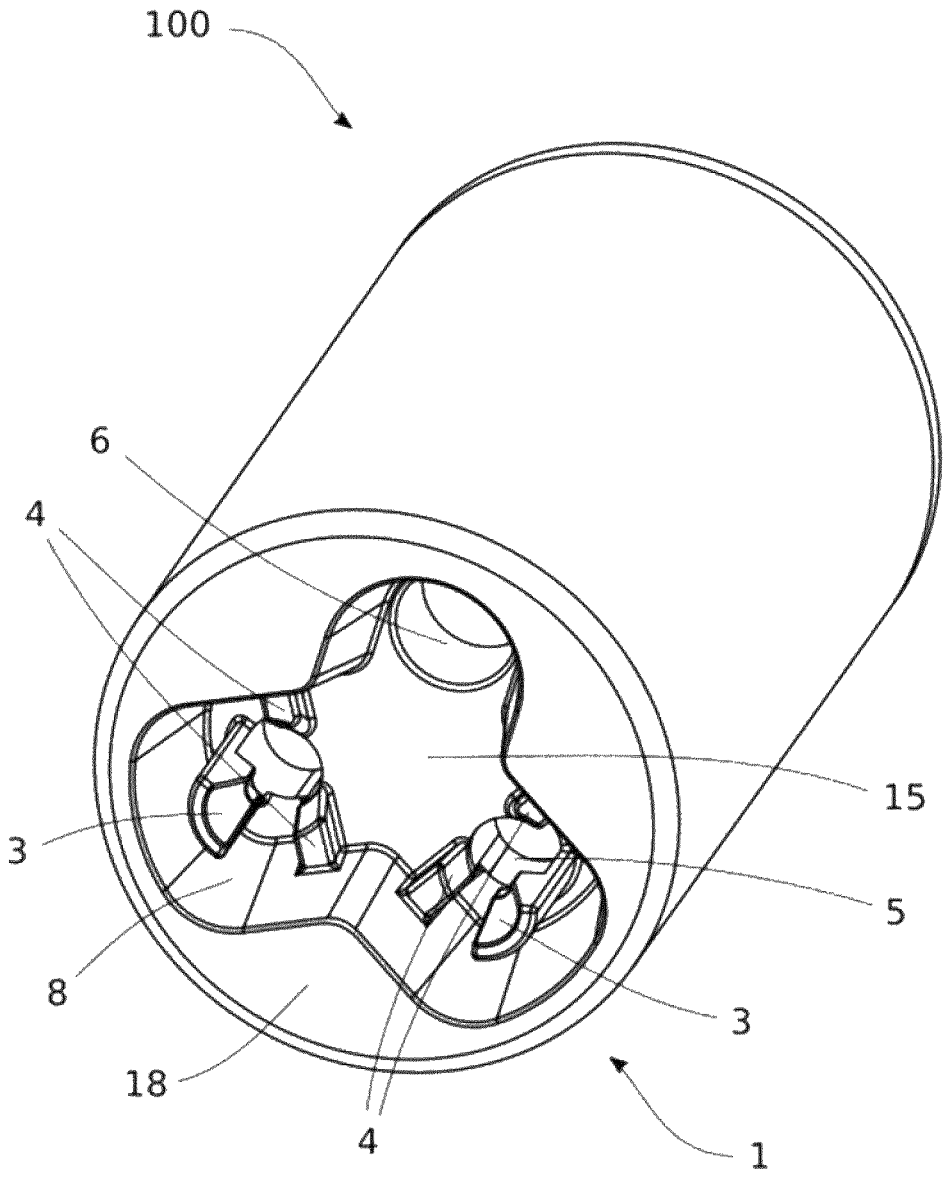
FIG. 7 shows a possible embodiment of the invention, with two holes for the detonator.

The openings (5, 6), which are circular in this embodiment but may have any other section, allow access to the holes (9, 10) of the booster (100). The second opening (5) which is coaxial with the blind hole (10), has flexible holding means (3) located next to the opening (5), such that the flexible holding means (3) are located at a distance from the opening (5) sufficient so as to leave the access free in the open position and to be interposed thereon in the closed position. In a possible embodiment, there is more than one second opening (5), envisaged for the case in which more than one detonator (13) is required for setting off the booster (100). FIG. 7 shows a particular embodiment of a retention device (1) comprising two second openings (5) and the corresponding two blind holes (10) for using the booster with two detonators. Similarly, embodiments with more than one first opening (6) are also possible to allow the passage of several wires of the detonator (13). FIGS. 4, 5 and 6 show with greater clarity a particular embodiment of the openings (5, 6), with an almost tubular shape projecting perpendicularly from the substantially flat portion (15) towards the inner face (17). This particular shape constitutes a further centering element for the detonator (13), while at the same time allows linking the openings (5, 6) with the holes (9, 10) of the booster (100).

As shown in the embodiments of FIGS. 4-9, the centering ribs (4) are elements attached to the substantially flat portion (15) that project outwards in a direction substantially perpendicular to the flat portion (15); furthermore, the centering ribs are arranged close to the border of the second opening (5). The function of these centering ribs (4) is to help the operator to center the detonator (13) in the opening (5). In a particular embodiment, the centering ribs (4) have an almost prismatic shape, with the face arranged opposite the opening (5) being substantially cylindrical, the free end thereof being a conical surface of revolution. FIG. 7 shows a particular embodiment with thinner centering ribs (4) than in the other embodiments shown. It is possible to arrange more than one centering rib (4) per opening, as shown in FIG. 7, as it is also possible to carry out the invention without any rib.

FIG. 4 shows a section of the retention device (1) in which the design of the flexible flange is seen. The flange comprises three parts: a rod attached to the flat portion (15) that will be referred to as a cylindrical inner part (3*c*), a flat intermediate part (3*b*), acting as a retainer and furthermore serving as a transition between the inner part and the end of the flange, and a free end (3*a*), substantially wider than the cylindrical inner part (3*c*), and with a conical shape of revolution.

Said shape is optimized to make introduction of a cylindrical detonator easier and to cause the movement of the free end (3*a*) of the flange in a radial direction when it is pushed axially with a detonator (13). Since the cylindrical inner part (3*c*) is attached to the retention device (1), the flange swivels and allows the passage of the detonator (13). When the detonator (13) is arranged completely in the blind hole (10), it no longer presses on the free end (3*a*) of the flange and allows the flange to return to the blocking or standby position. In the blocking position, the detonator (13) is retained on the edge of the flat intermediate part (3*b*) of the flange, even pulling on the wires of the detonator.

Figure 8:
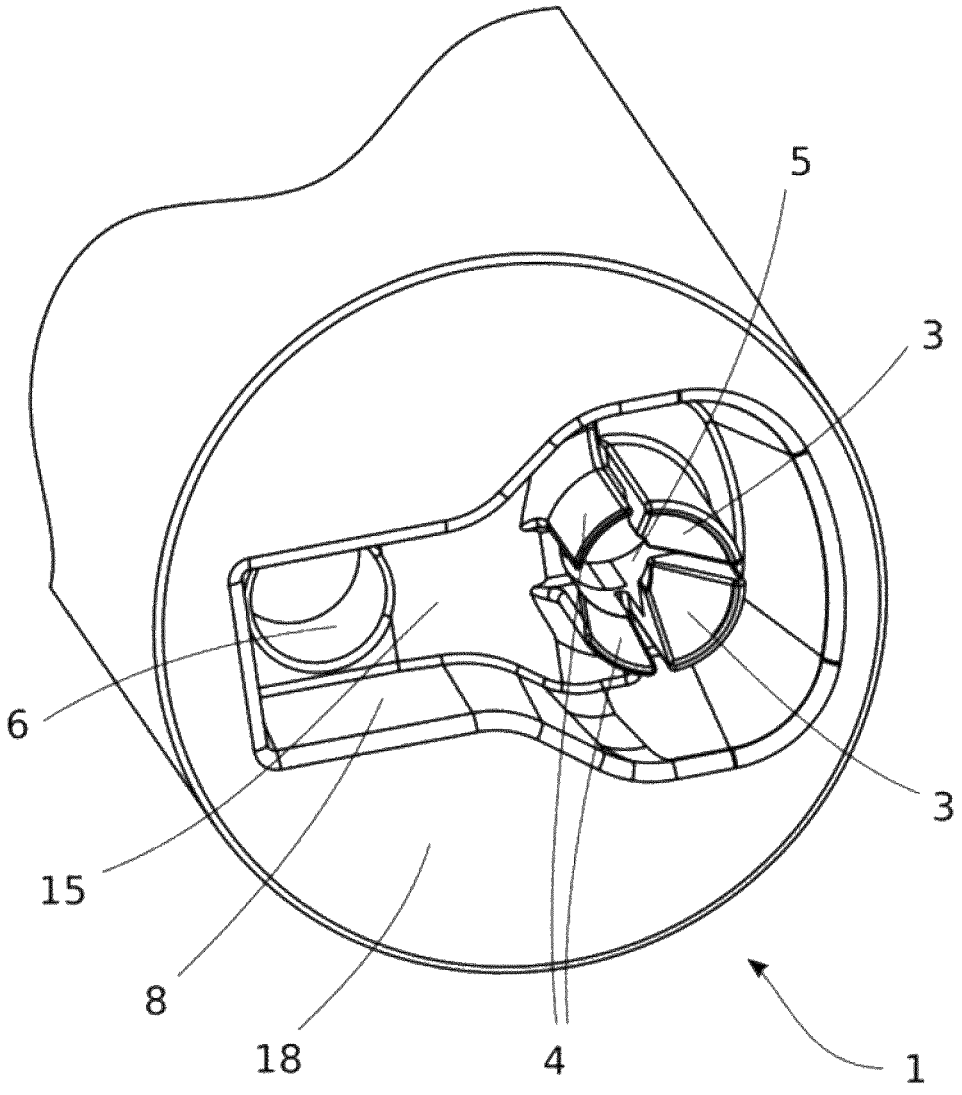
FIG. 8 shows a possible embodiment of the retention device with two flanges.
Figure 9:
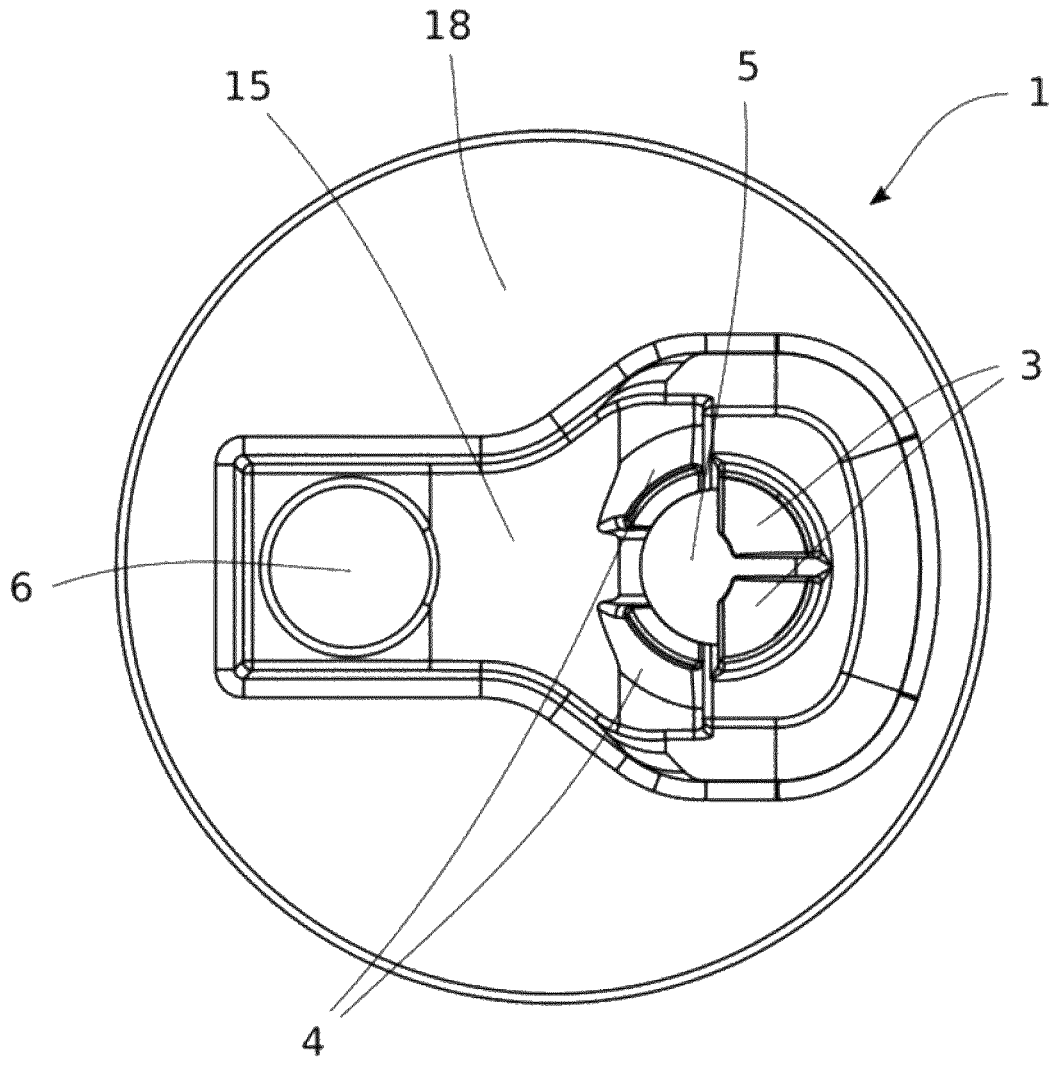
FIG. 9 shows a bottom view of the booster with two flanges.

FIGS. 8 and 9 show a particular embodiment with two flexible flanges. In these drawings, the two flanges are arranged covering almost half the second opening (5); the incorporation of the second flange increases the safety of the retention device (1) because it allows obstructing almost half the second opening (5), assuring the retention of the detonator (13), and because if one of the flanges breaks or is rendered useless, the other one would allow retaining the detonator (13) in the blind hole (10).

The protective element (20), which can be seen in detail in FIG. 5, is an element of the retention device (1) offering shelter to the holding means (3) and other elements of the device (1), which due to their shape are susceptible of getting caught on something or sustaining blows rendering them useless. The protective element (20) is defined based on a substantially flat surface (18) located above the flange and of the centering ribs (4), such that it acts as a casing for the retention device (1). To make access to the flange and the openings (5, 6) easier, the protective element (20) has a recess (19) in its central area, slightly wider around the flange; said recess (19) is connected with the substantially flat portion (15) through a wall (8).

Method of Putting in and Taking Out a Detonator

When the operator is going to use the explosive booster, he passes the detonator completely through the cavity (11) of the cover (2) and the through hole (9), the detonator coming out through the first opening (6). Then, the detonator is introduced in the second opening (5), pressing on the conical face of the free end (3*a*) of the flange, and passing through the centering ribs (4). When the entire detonator (13) has been introduced into the blind hole (10), the flange is no longer bent, and the edge of the intermediate flat part (3*b*) of the flange acts as a mechanical retainer for retaining the detonator. The detonator is therefore held during the introduction of the booster assembly into the shot hole.

Figure 10:
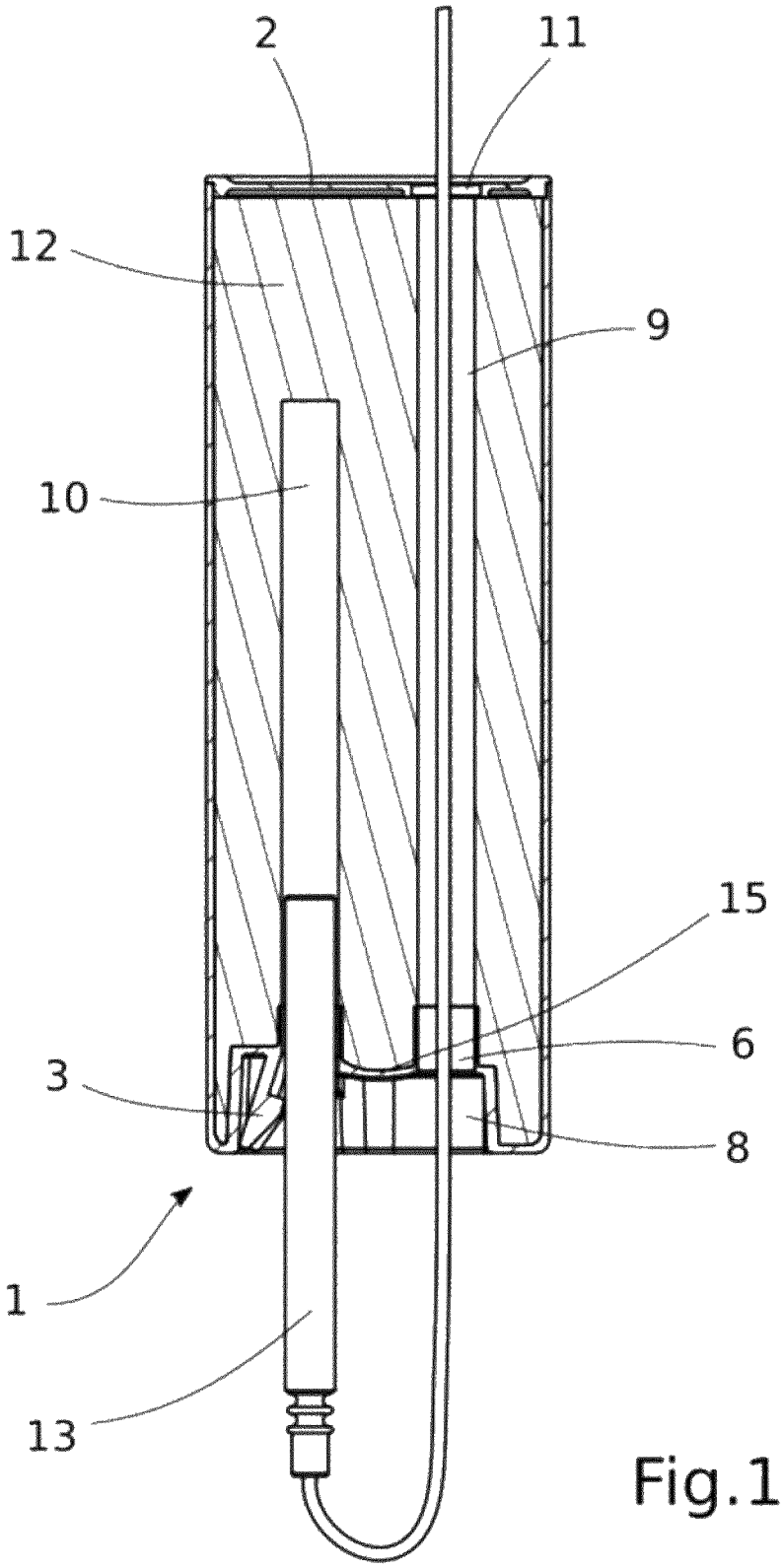
FIG. 10 shows a longitudinal section of the booster with a detonator partially inserted in the blind hole.

FIG. 10 shows a section of the booster (100) in the moment in which the detonator (13) is introduced into the blind hole (10). The flange (3) is seen in the open position, moved radially with respect to the axis of the through hole (10).

Figure 11:
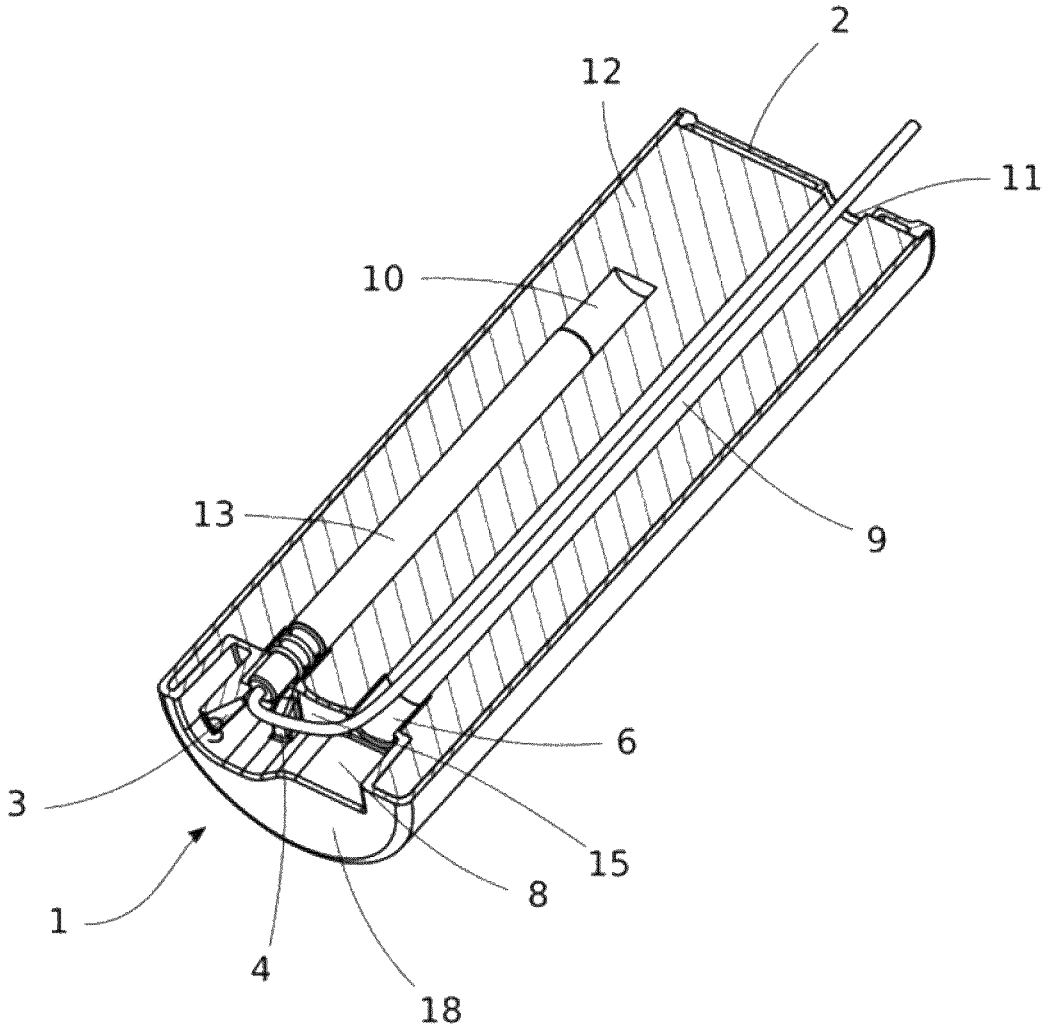
FIG. 11 shows another longitudinal section of the booster with a detonator completely inserted and retained in the blind hole.

FIG. 11 shows the booster (100) with the detonator (13) introduced completely into the hole (10) thereof. The flexible flange (3) prevents its extraction, even when pulling on the wires of the detonator. Depending on the type of detonator, retention occurs in the cap of the detonator or in the channels of the crimper of the detonator (13).

Similarly, if the operator decides to take out or extract the detonator (13) from inside the booster (100), he must press on the flexible flange, bending it, and pulling on the wires of the detonator. This operation of bending the flange can be performed simply with one finger or with any tool.

The invention claimed is:

1. A retention device adapted to retain detonators inside a booster, said booster comprising:

an explosive charge, a through hole comprising a first end and a second end, and a blind hole comprising one end, wherein the retention device comprises, at least one outer face and at least one inner face, at least one substantially flat portion on said at least one outer face, at least one flexible holding device located substantially in said at least one substantially flat portion on the at least one outer face, at least one first opening located in said at least one substantially flat portion, and at least one second opening located in said at least one substantially flat portion, wherein the at least one first opening is adapted to allow the detonator to access the through hole, and the at least one second opening is adapted to allow the detonator to access the blind hole, wherein the at least one flexible holding device is arranged substantially next to each at least one second opening, and said flexible holding device comprises a flange connected to the at least one substantially flat portion, wherein the flange comprises (i) a flat retaining edge that is substantially parallel to the at least one substantially flat portion, and (ii) a free end defined as a conical or flat, and inclined surface of revolution, wherein the flat retaining edge of the flange is positioned in closer proximity to the at least one second opening, wherein the flange will deflect in a radial direction when the free end is pushed axially but will not deflect when a force is exerted perpendicular to the flat retaining edge.

2. The retention device according to claim 1, additionally comprising a protective element, said protective element comprising a substantially flat surface with a recess, said recess being adapted for housing the at least one substantially flat portion, the at least one flange, the at least one first opening and the at least one second opening, thus permitting access to the at least one flange.

3. The retention device according to claim 2, wherein the at least one substantially flat portion and the substantially flat surface of the protective element are connected through a wall.

4. The retention device according to claim 1, comprising one or more centering ribs arranged in the at least one substantially flat portion and substantially next to each at least one second opening, the one or more centering ribs being adapted to guide a detonator through each at least one second opening when said detonator is introduced in said at least one second opening.

5. The retention device according to claim 1, comprising two second openings.

6. The retention device according to claim 1, wherein the at least one flange is movable from outside of the booster between a blocking position retaining a detonator inside the blind hole and an open position to extract the detonator from said blind hole.

7. The retention device according to claim 1, comprising one or two flanges.

8. The retention device according to claim 1, wherein the retention device is prismatic or cylindrical.

9. A booster comprising an explosive charge and a retention device according to claim 1, wherein the retention device is located at one of the ends of the booster.

10. The booster according to claim 9, wherein the booster has a cylindrical or prismatic shape.

11. The booster according to claim 9, comprising a case, wherein the case of the booster is adapted to contain the explosive charge and the retention device is located at a first end of the case.

12. The booster according to claim 11, comprising a cover located at a second end of the case.

13. The booster according to claim 12, comprising at least one through hole in the explosive charge and at least one blind hole in the explosive charge, such that the longitudinal axis of each through hole coincides with the longitudinal axis of each first opening of the retention device and the longitudinal axis of each blind hole coincides with the longitudinal axis of each second opening of the retention device.

14. The booster according to claim 9, wherein there are no plastic tubes defining the blind hole, the through hole, or both the blind hole and the through hole.

15. The retention device according to claim 1, wherein the at least one flange is moved to the open position using a finger or tool.

16. A method of assembling a booster assembly, said method comprising the following steps:

providing a booster according to claim 13, introducing a detonator through a first end of the through hole of the booster, until the detonator comes out through the second end of the through hole of the booster, and introducing the detonator through the end of the blind hole of the booster by applying force on the free end of the at least one flange thus moving the at least one flange from an blocking position to an open position, such that when the detonator is completely housed in the blind hole, the at least one flange returns to the blocking position.

17. A method of disassembling a booster assembly, said method comprising the following steps:

providing a booster assembly comprising the booster of claim 13 and a detonator, wherein detonator is completely housed in the blind hole and the at least one flange is in an blocking position, unblocking the at least one flange by applying axial force on the free end thus moving the at least one flange from the blocking position to an open position, and pulling on the end of the detonator and extracting the detonator from the booster.

* * * * *